United States Patent [19]

Michael et al.

[11] 4,258,288

[45] Mar. 24, 1981

[54] RESISTOR-AIDED STARTING OF METAL HALIDE LAMPS

[75] Inventors: Jacob F. Michael, Paramus; Daniel A. Larson, Cedar Grove, both of N.J.

[73] Assignee: Westinghouse Electric Corp., Pittsburgh, Pa.

[21] Appl. No.: 37,582

[22] Filed: May 9, 1979

[51] Int. Cl.[3] ..... H01J 7/44; H01J 17/34; H01J 19/78; H01J 29/96

[52] U.S. Cl. ..... 315/60; 315/DIG. 5; 315/73; 315/234; 315/264

[58] Field of Search ..... 315/60, 73, DIG. 5, 315/DIG. 7, 234, 264, 263

[56] References Cited

U.S. PATENT DOCUMENTS

| | | | |
|---|---|---|---|
| 2,020,737 | 11/1935 | Pirani et al. | 315/60 X |
| 3,262,012 | 7/1966 | Koury et al. | 315/100 |
| 3,445,721 | 5/1969 | Waymouth | 315/60 |
| 3,619,710 | 11/1971 | Waymouth | 315/47 |
| 3,900,761 | 8/1975 | Freese et al. | 315/60 |
| 4,010,398 | 3/1977 | Meuwes | 315/DIG. 5 |
| 4,013,919 | 3/1977 | Corbley | 315/73 |

*Primary Examiner*—Saxfield Chatmon, Jr.
*Attorney, Agent, or Firm*—R. S. Lombard

[57] ABSTRACT

A metal halide high-intensity discharge lamp for connection to a constant wattage-type mercury ballast including a transformer having a secondary winding having a capacitor in series circuit arrangement therewith. The lamp includes starting aid means and warm-up assistance means to ensure reliable operation. The starting aid means is a voltage doubler comprising a diode and two resistors operating in conjunction with the ballast capacitor and also including a normally closed heat-responsive switch means operative to prevent voltage stress on the diode after the lamp starts. The warm-up assistance means comprises a resistor in series circuit arrangement with the arc tube and a normally open heat-responsive switch means connected in parallel circuit arrangement with the resistor so that during lamp warm up, the resistor reduces the phase shift between the voltage of the lamp and the open circuit voltage of the ballast, thereby increasing the maximum sustaining voltage to the lamp when the lamp current is zero, to prevent the arc from extinguishing.

6 Claims, 5 Drawing Figures

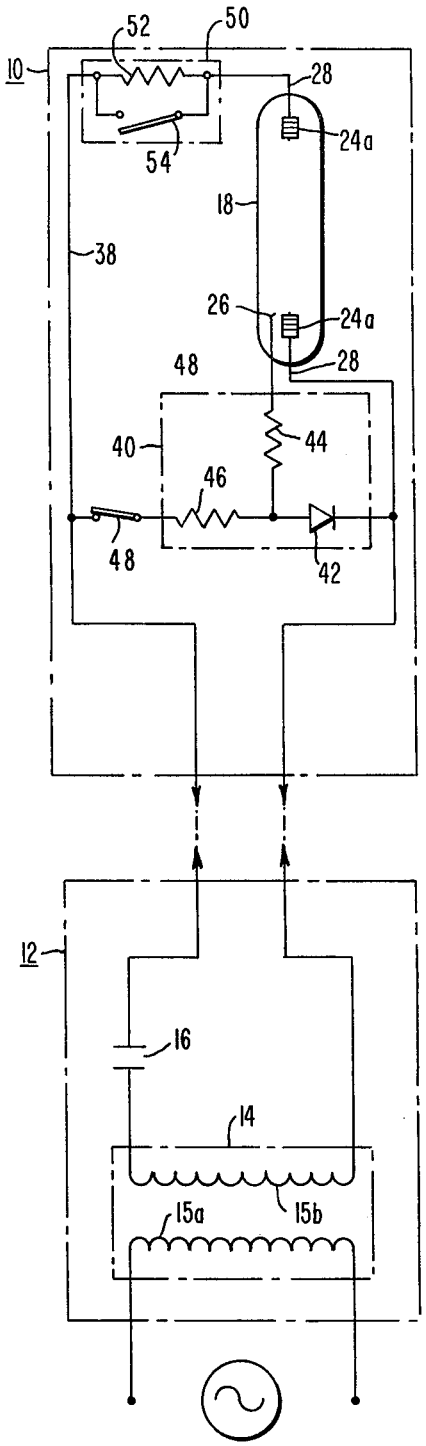
FIG.2
FIG.3
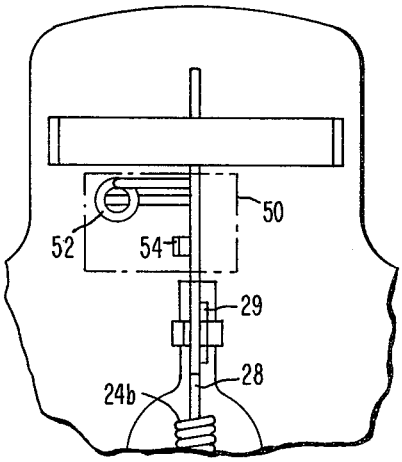

RESISTOR-AIDED STARTING OF METAL HALIDE LAMPS

CROSS-REFERENCE TO RELATED APPLICATION

In copending application Ser. No. 037,582, filed concurrently herewith by one of the present applicants, J. F. Michael, and owned by the present assignee, is disclosed a metal halide lamp for connection to a constant wattage-type mercury ballast, which includes starting aid means to permit starting on mercury ballast.

BACKGROUND OF THE INVENTION

This invention relates to metal halide high intensity discharge lamps and, in particular, to a metal halide lamp operative with a constant wattage-type mercury ballast.

One such lamp is disclosed in U.S. Pat. No. 3,262,012, dated July 19, 1966, issued to F. Koury et al. This lamp comprises an envelope containing a vaporizable, positively ionizable material, at least two electrodes enclosed by the envelope between which an electric arc discharge is established, electric impedance means connected in series with one of the electrodes, and thermostatic switch means responsive to heat from the arc to shunt the impedance. With the impedance in series with an external ballast, current flow is maintained sufficiently high between peaks to prevent extinction of the arc during the period that the arc tube is warming up to operating temperature and impedance.

A metal halide lamp utilizing a voltage doubler circuit is described in U.S. Pat. No. 3,900,761, dated Aug. 19, 1975, issued to Freese et al. This lamp is described as having two main electrodes and a starter electrode, and has a resistor and a diode connected between the starter electrode and the adjacent main electrode. A second resistor is in circuit between the starter electrode and its connector to an external power supply. This circuit permits the lamp to be started on a high-pressure mercury vapor lamp ballast.

A lamp utilizing a thermally operative switch to isolate the starter electrode is disclosed in U.S. Pat. No. 3,619,710, dated Nov. 9, 1971, issued to John F. Waymouth. The Waymouth patent discloses that in an arc tube of an arc discharge lamp having two main electrodes and a starter electrode adjacent one of them, with the starter electrode being electrically connected to the adjacent electrode through a resistor external the arc tube, the starter electrode is electrically connected to the other main electrode through a thermally operative switch and a second resistor. In normal operation the switch opens after lamp ignition to isolate the starter electrode from the circuit of the other main electrode and to place the starter electrode at substantially the same potential as the adjacent main electrode to prevent electrolysis of the molybdenum ribbon leading to the starter electrode.

A lamp utilizing a fuse heater and a shunting thermal switch is disclosed in U.S. Pat. No. 4,013,919, dated Mar. 22, 1977, issued to Eugene K. Corbley. The lamp comprises an inner arc tube and an outer glass envelope. The outer glass envelope normally prevents the emission of ultraviolet radiation, but if the outer envelope is broken, such harmful radiation may be released. To prevent this, a fuse heater and shunting thermal switch is connected in series with the arc tube and located within the outer envelope. Should the outer envelope be broken, air cools the switch so that it opens. Current flow through the heater then raises its temperature and causes it to oxidize, thereby opening the circuit and disabling the lamp.

SUMMARY OF THE INVENTION

A metal halide high-intensity discharge lamp for connection to a constant wattage-type mercury ballast including a transformer having a primary winding and a secondary winding—the secondary winding having a capacitor means in series circuit arrangement therewith. The lamp comprises an elongated radiation-transmitting protective outer envelope. The arc tube encloses a discharge-sustaining filling and has operating electrodes operatively positioned therein proximate the ends thereof. A starting electrode is positioned in close proximity to one of the operating electrodes. Electrical lead-in means are sealed through the arc tube and connected to the operating electrodes. Electrical adapter means are affixed to the outer surface of the protective envelope to facilitate electrical connection of the lamp to source of electrical power. The electrical adapter means comprise a metallic shell portion and metallic eyelet separated by an electrical insulating means. Elongated conductor means electrically connect the other of the operating electrodes to the shell portion.

Starting aid means is positioned within the outer envelope and comprises diode means connected in circuit between the one operating electrode and the starting electrode, first resistor means connected in circuit between the starting electrode and the diode means, and second resistor means connected in circuit between the diode means the elongated conductor means. The starting aid means also includes a normally closed temperature responsive switch means connected in circuit between the second resistor means and the elongated conductor means and is positioned in close proximity to the arc tube to cause the normally closed switch means to open when the normally closed switch means is heated by the arc tube during lamp operation.

Warm-up assistance means is positioned within the protective outer envelope. The warm-up assistance means comprises a third resistor means connected in circuit between the other electrode and the shell portion, and a normally-open heat-responsive switch means positioned in close proximity to the arc tube and connected in parallel circuit arrangement with the third resistor means, whereby the third resistor means reduces the phase shift between the voltage of the lamp and the open circuit voltage of the ballast thereby increasing the maximum sustaining voltage to the lamp when the lamp current is zero.

BRIEF DESCRIPTION OF THE DRAWINGS

For a better understanding of the invention, reference may be had to the accompanying drawings, in which:

FIG. 2 is a circuit diagram of the lamp of FIG. 1 in conjunction with a constant wattage-type ballast;

FIG. 3 is a side elevation sectional view showing the mounting arrangement of the warm-up assistance means;

DESCRIPTION OF THE PREFERRED EMBODIMENT

Figure 1:
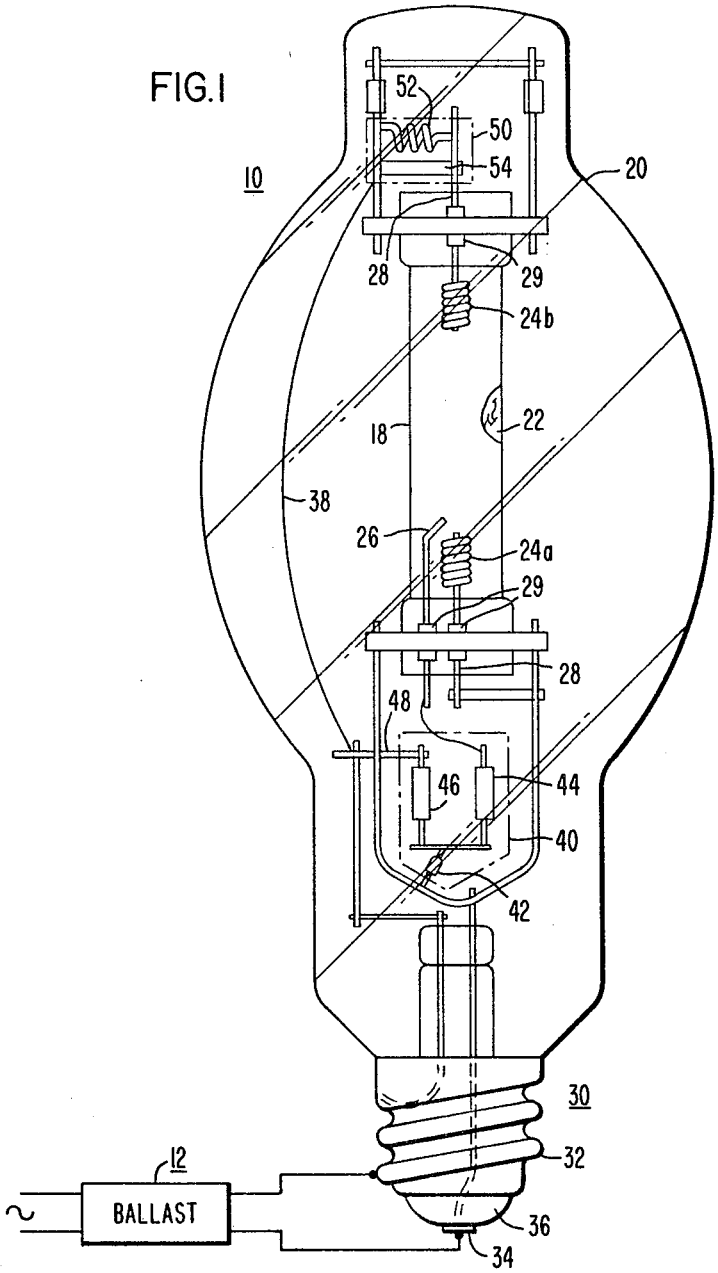
FIG. 1 is an elevational view of a metal halide high-intensity discharge lamp embodying the invention.

Referring to FIGS. 1 and 2, there is provided a metal halide high-intensity discharge lamp 10 for connection to a constant wattage-type mercury ballast 12. The ballast 12 includes a transformer 14 having a primary winding 15 *a* and a secondary winding 15 *b* which windings, as shown in FIG. 2, may be separate windings or a single winding in autotransformer relationship. The transformer also includes capacitor means 16 in series circuit arrangement with the secondary winding 15 *b*. The lamp 10 comprises an elongated radiation-transmitting arc tube 18 typically made of quartz. The arc tube 18 is enclosed by and supported within a protective outer envelope 20. The arc tube 18 encloses a discharge-sustaining filling 22 comprising mercury and one or more metal halides, typically sodium iodide and scandium iodide, as is well known in the art. The arc tube 18 has operating electrodes 24*a*, 24*b* made of tungsten operatively positioned within the arc tube 18 proximate the ends thereof and a starting electrode 26 positioned in close proximity to one of the operating electrodes 24*a*, whereby during starting of the lamp 10 an arc is first established between the starting electrode 26 and the one operating electrode 24*a* until the discharge-sustaining filling 22 becomes sufficiently ionized to establish an arc between the one operating electrode 24*a* and the other operating electrode 24*b*. The electrical lead-in means 28 include molybdenum ribbon members 29 sealed through the arc tube 10 and connected to the operating electrodes 24*a*, 24*b*. Electrical adapter means 30 is affixed to the outer surface of the protective envelope 32 to facilitate electrical connection of the lamp 12 to a source of electrical power 31. the electrical adapter means 30 comprises a metallic shell portion 32 and a metallic eyelet 34 separated by an electrical insulating means 36. Elongated conductor means 38 electrically connect the other operating electrode 24*b* to the shell portion. 32

Starting aid means 40 is positioned within the protective envelope 20. The starting aid means 40 comprises diode means 42 connected in circuit between the one operating electrode 24*a* and the starting electrode 26. The starting aid means 40 also includes first resistor means 44 connected in circuit between the starting electrode 26 and the diode means 42 and second resistor means 46 connected in circuit between the diode means 42 and the elongated conductor means 38. The starting aid means 40 further includes normally closed temperature responsive switch means 48 connected in circuit between the second resistor means 46 and the elongated conductor means 38 and positioned in close proximity to the arc tube 10 to cause the normally closed switch means 48 to open when the normally closed switch means is heated by the arc tube 10 during normal lamp operation. This prevents unnecessary voltage stress of the diode means 42 and electrolysis of the lead-in means 28 which typically comprise molybdenum. The starting aid means 40 operates as a voltage doubler in conjunction with capacitor means 16.

Referring to FIG. 2 and 3, warm-up assistance means 50 is positioned within the protective outer envelope 20 and comprises third resistor means 52, typically a tungsten filament, connected in circuit between the other electrode 24*b* and the shell portion 32. the warm-up assistance means 50 also comprises normally opened heat responsive switch means 54 positioned in close proximity to the arc tube 18 and connected in parallel circuit arrangement with the third resistor means 52. The third resistor means 52 is preferably offset from the axis of lamp 10 so that the emergency emitted by resistor means 52 does not appreciably contribute to the heating of the heat responsive switch means 54. The warm-up assistance means 50 increases the maximum sustaining voltage to the lamp when the lamp current is zero by utilizing the resistance of the third resistor means which reduces the phase shift between the the lamp voltage and the open circuit voltage of the ballast.

As an example, a 400-watt metal halide lamp was made utilizing the following components for the starting aid means 40 and the warm-up assistance means 50.

| COMPONENTS | |
|---|---|
| Reference Identification | |
| 42 | General Instrument Diode #5061 |
| 44, 46 | 40 KΩ, |
| 48, 54 | Bimetal switch 0.008" × 0.125" Truflex B-1 |
| 52 | Tungsten filament 16.4Ω |

Figure 4A:
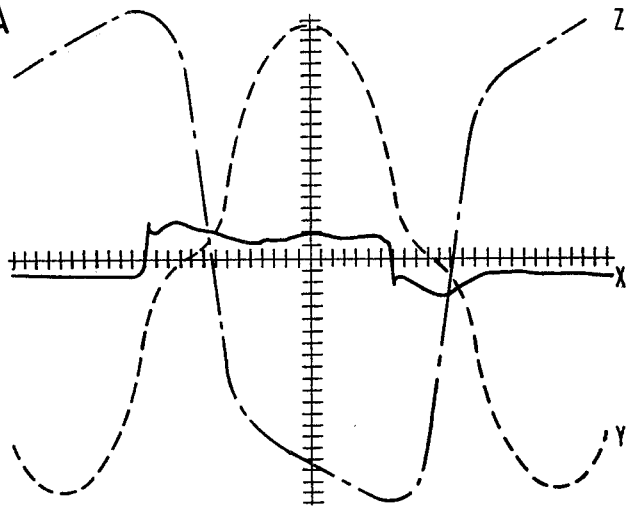
FIG. 4A is a graph of showing ballast open circuit voltage, lamp voltage, and capacitor voltage for 400 watt metal halide lamp during warm-up without the warm-up assistance means; and, FIG. 4B is a graph showing ballast open circuit voltage, lamp voltage and capacity voltage of a 400 watt metal halide during warm-up with the warm-up assistance means.
Figure 4B:
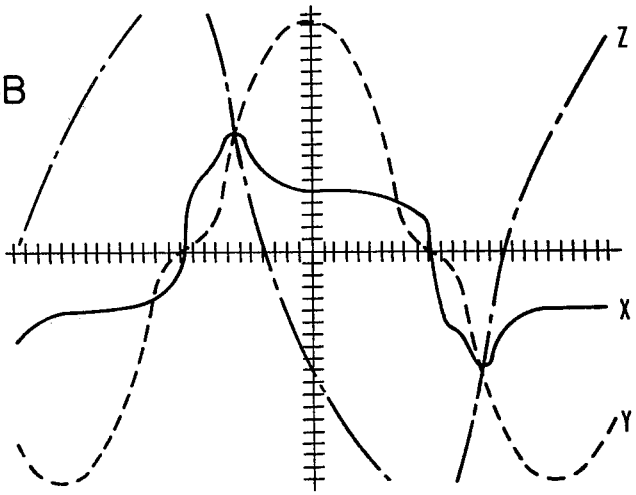

In FIGS. 4A and 4B the voltage waveforms of the lamp are compared to a lamp without the warm-up assistance means 50. The lamp without warm-up assistance means develops a resistance to the reignition that occurs each half cycle. This resistance must be overcome by the available reignition voltage of the ballast. The available reignition voltage at the instant the lamp current reverses is equal to the peak capacitor voltage minus the instantaneous open circuit ballast voltage. In FIG. 4A, three voltage waveforms are shown. The center waveform (X) approaches a square wave which is the voltage waveform of the arc tube after having been operated for approximately 1.75 minutes. The second waveform (Y) appears as a distorted sine wave which is the ballast open circuit voltage. The third waveform (Z) is the voltage across the capacitor 16. The third waveform (Z) is just barely going off scale in FIG. 4A. The horizontal scale is divided into two milliseconds per measured division, and the vertical scale is divided into $\phi$ volts per measured division for all three waveforms. As can be seen from FIG. 4A, the instant lamp voltage reverses, the capacitor voltage has a peak value of about +400 volts, the instantaneous open circuit voltage is about −150 volts, therefore, the available reignition voltage is the difference between these two or about 250 volts.

The phase shift between the ballast open circuit voltage and the lamp voltage during warm up is caused by a small resistive component in the circuit; the total circuit impedance is essentially reactive. As the lamp warms up, it becomes a resistive element in the circuit, bringing the lamp voltage and the open circuit voltage into a closer phase relationship. Utilizing the warm-up assistance means 50, the lamp 10 acts as a resistive load right from the time of starting the lamp. This is a result of the third resistor means being connected in series circuit arrangement with the arc tube 18 during the warm-up period and removing it after the arc tube has become sufficiently warm to act as a resistive load for the ballast. The effectiveness of this is shown in FIG. 4B. The same three voltage waveforms that were shown in FIG. 4A are shown in FIG. 4B. As can be seen in FIG. 4B, the peak capacitor voltage is greater than in FIG. 4A, being about 425 volts, and the ballast instantaneous open circuit voltage at the time the lamp voltage is zero, is also zero. Therefore the available reignition voltage is the difference between these two or about 425 volts.

It has been found that the warm-up assistance means 50 will be effective if the third resistor means 52 comprising a tungsten filament has a resistance from about 3 to 25 ohms when used with a 400-watt lamp.

We claim:

1. A metal halide high-intensity discharge lamp for connection to a constant wattage-type mercury ballast including a transformer having a primary winding and a secondary winding, said secondary winding having capacitor means in series circuit arrangement therewith, said lamp comprising:

an elongated radiation-transmitting arc tube enclosed by and supported within a protective outer envelope, said arc tube enclosing a discharge-sustaining filling and having operating electrodes operatively positioned therein proximate the ends thereof and a starting electrode positioned in close proximity to one of said operating electrodes;

electrical lead-in means sealed through said arc tube and connected to said operating electrodes;

electrical adapter means affixed to the outer surface of said protective envelope to facilitate electrical connection of said lamp to a source of electrical power, said electrical adapter means comprising a metallic shell portion and a metallic eyelet separated by an electrical insulating means;

elongated conductor means electrically connecting the other of said operating electrodes to said shell portion;

starting aid means positioned within said protective outer envelope comprising diode means connected in circuit between said one operating electrode and said starting electrode, first resistor means connected in circuit between said starting electrode and said diode means, and second resistor means connected in circuit between said diode means and said elongated conductor means;

normally closed temperature responsive switch means connected in circuit between said second resistor means and said elongated conductor means and positioned in close proximity to said arc tube to cause said normally closed switch means to open when said normally closed switch means is heated by said arc tube during normal lamp operation;

warm-up assistance means positioned within said protective outer envelope comprising third resistor means connected in circuit between said other operating electrode and said shell portion, and normally open heat responsive switch means positioned in close proximity to said arc tube and connected in parallel circuit arrangement with said third resistor means, whereby said third resistor means reduces the phase shift between the voltage of said lamp and the open circuit voltage of said ballast thereby increasing the maximum sustaining voltage to said lamp when the lamp current is zero.

2. The lamp of claim 1, wherein said normally closed heat responsive switch means is a normally closed bimetallic switch.

3. The lamp of claim 1, wherein said normally open heat responsive switch means is a normally open bimetallic switch.

4. The lamp of claim 1, wherein said electrical lead-in means comprise molybdenum.

5. The lamp of claim 1, wherein said third resistor means is a tungsten filament.

6. The lamp of claim 5, wherein said tungsten filament is offset from the axis of said lamp.

* * * * *